United States Patent [19]

Zola

[11] Patent Number: 4,856,043

[45] Date of Patent: Aug. 8, 1989

[54] TWO PIECE CERAMIC SOLLER SLIT COLLIMATOR FOR X-RAY COLLIMATION

[75] Inventor: John J. Zola, Ramsey, N.J.

[73] Assignee: North American Philips Corporation, New York, N.Y.

[21] Appl. No.: 220,775

[22] Filed: Jul. 18, 1988

[51] Int. Cl.[4] ..... G21K 1/02

[52] U.S. Cl. ..... 378/149; 378/147

[58] Field of Search ..... 378/147, 149, 82, 84; 250/505.1, 515.1; 252/478

[56] References Cited

U.S. PATENT DOCUMENTS

| | | | |
|---|---|---|---|
| 4,170,735 | 10/1979 | Codina et al. | 378/98 |
| 4,223,219 | 9/1988 | Born et al. | 378/84 |
| 4,256,961 | 3/1981 | Shoji et al. | 378/85 |
| 4,271,353 | 6/1981 | Ohtsuki et al. | 378/83 |
| 4,284,887 | 8/1981 | Kusumoto et al. | 378/82 |
| 4,322,618 | 3/1982 | Jenkins | 378/84 |
| 4,364,122 | 12/1982 | Wölfel et al. | 378/73 |
| 4,426,719 | 1/1984 | Fraenkel | 378/84 |
| 4,580,283 | 4/1986 | Hornstra | 378/82 |

*Primary Examiner*—Carolyn E. Fields
*Assistant Examiner*—David P. Porta
*Attorney, Agent, or Firm*—Norman N. Spain

[57] ABSTRACT

A Soller slit and method of producing a Soller slit by forming a plurality of grooves in two identical ceramic blocks. The two blocks are then bound together with parallel blades of each block facing each other. The ceramic blocks can contain lead titanate.

12 Claims, 3 Drawing Sheets

TWO PIECE CERAMIC SOLLER SLIT COLLIMATOR FOR X-RAY COLLIMATION

BACKGROUND OF THE INVENTION

The invention in this case relates to a novel Soller slit X-ray collimator and to the method of manufacturing such a collimator. An X-ray analytic instrument employed for the characterization of materials such as diffracted beam monochromators and X-ray spectrometers it is desirable that the incident and exiting beams be collimated to parallel beams in order to minimize axial divergence. In powder diffractometers reducing axial divergence of the beams, improves the resolution and precision of the angular measurements and eliminates smearing aberrations.

In X-ray spectrometers fine collimation of the incident beams is necessary to improve sensitivity of measurements.

In other X-ray instruments such as X-ray diagnostic apparatus such as is used in computer assisted tomography fine collimation acts to eliminate image blurring.

Collimation is frequently achieved by use of Soller slit collimators.

The use of these collimators is well documented and is described for example in M. P. Klug and L. E. Alexander, X-ray Diffraction Procedures, New York, John Wiley & Sons, 1954, pages 241, 242, 251–253 and 275–277; Brandt et al U.S. Pat. No. 4,361,902, Wolfel U.S. Pat. No. 4,364,122; Jenkins U.S. Pat. No. 4,322,618 and Kusumoto et al U.S. Pat. No. 4,284,887.

A Soller slit collimator that is frequently used comprises a stack of thin blades parallel positioned, separated by narrower spaces and clamped together into housing assembly. The blades are formed of foils of materials absorbent of the X-rays being employed.

This type of collimator is quite expensive as it requires a large amount of hand assembly. Further the thinness of the blades and the narrowness of the spaces between the blades, and thus the fineness of the collimation is limited in these collimators by the fact that foil blades tend to warp when clamped into the assembly housing particularly as they become thinner. Thus, in order to improve the fineness of the collimation, it is necessary that such collimators by made longer. However, it is frequently desirable that the collimator be as short as possible.

SUMMARY OF THE INVENTION

It is a principal object of this invention to provide a Soller slit X-ray collimator of improved construction in which the costly and time consuming mechanical construction methods now employed are eliminated.

Another object of this invention is to provide a Soller slit X-ray collimator not subject to blade warping and which is able to achieve an improved degree of collimation.

These objects are achieved by the new and novel collimator of the invention. The novel collimator of the invention comprises two rectangular ceramic blocks, each being of essentially identical composition and configuration and each containing heavy elements and capable of absorbing X-radiation, each block having a plurality of parallel blades projecting out of a solid wall portion and each blade being in contact and in parallel facing relationship with a corresponding blade of the other block and both blocks being adhesively bound to each other at corresponding facing surfaces of the side wall portions of the blocks.

A further aspect of the invention relates to a novel and improved method of producing a Soller slit X-ray collimator.

The method of the invention comprises the steps of forming an identical plurality of thin essentially identically dimensioned, parallel grooves separated by thin projections or blades, the length of each blade matching the lengths of the grooves, in similar surfaces of rectangular ceramic blocks, each being of essentially identical composition and configuration and capable of absorbing X-ray radiation. The grooves being formed in such a manner that each block is provided with side wall portions parallel to the grooves and each groove extends completely through the block.

Two of the blocks are then brought into a face-to-face relationship with each other in such a way that corresponding surfaces of the side wall portions and the corresponding blades are in mutual contact and in essentially parallel relationship with each other, and the blocks, while in this contacting relationship, are adhesively bound together along the corresponding surfaces of the side wall portions.

DETAILED DESCRIPTION OF THE INVENTION

Figure 1:
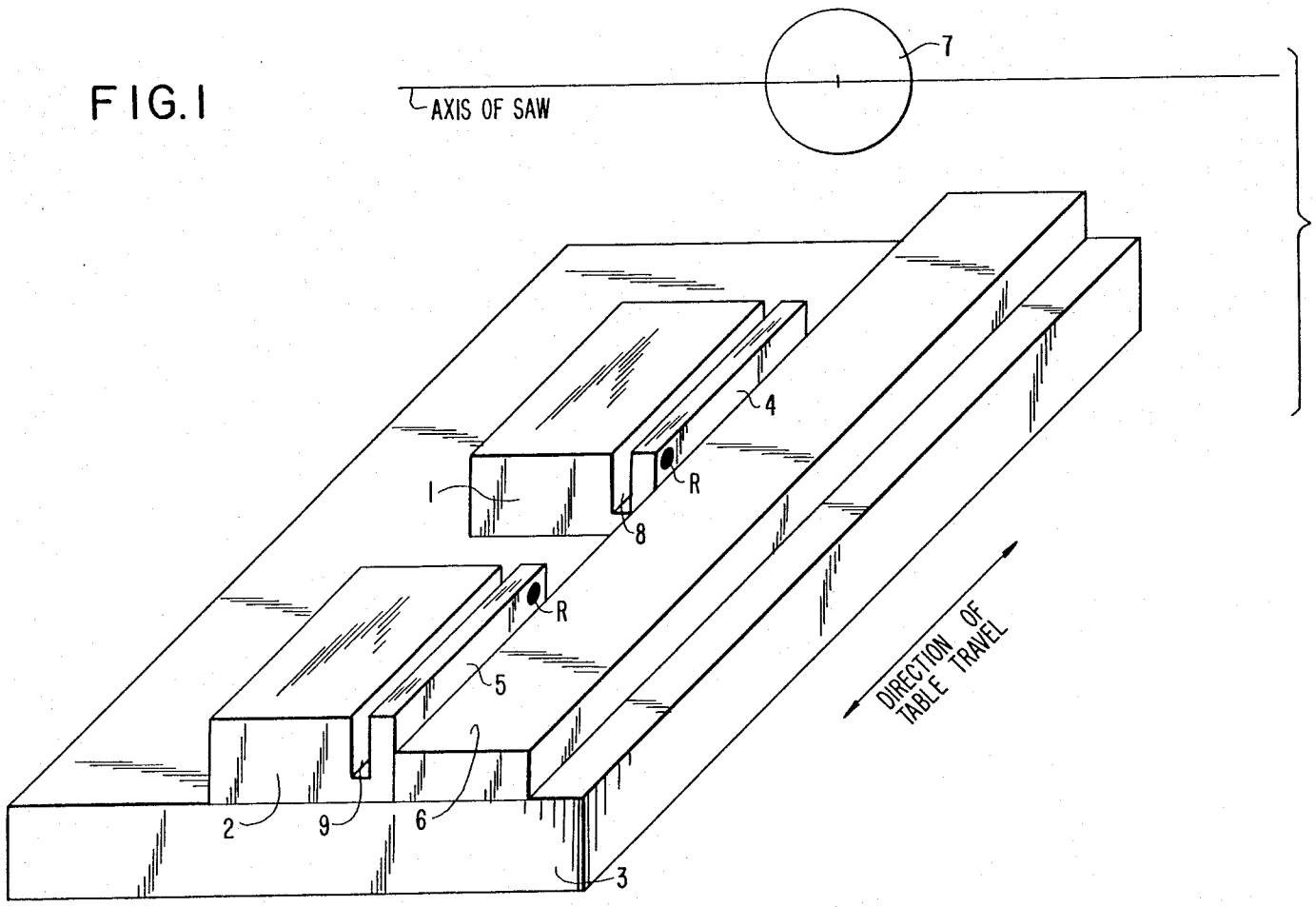
FIG. 1 is a diagrammatic view of an arrangement for providing grooves in the ceramic blocks employed in the method of the invention.

In a preferred method of the invention two rectangular ceramic blocks of essentially identical composition and configuration, each formed of a material capable of absorbing X-ray radiation, are positioned in a single plane in such a manner that a surface of one of the blocks is parallel with, and opposing to a surface of the other block, and an axis of one of said blocks is convergent with an axis of the other block, and forming, while in this position, a plurality of thin grooves, perpendicular to these two surfaces, the grooves being parallel to each other and being separated by thin projections or blades projecting from a surface of the ceramic blocks. The grooves are formed in the blocks in a manner such that each block is provided with side wall portions parallel to the grooves. The two blocks are then brought into a face-to-face relationship with each other in such a way that corresponding surfaces of the side wall portions and the corresponding blades formed in the blocks are in mutual contact and in essentially parallel relationship with each other and the thus contacting blocks are then adhesively bound together along the corresponding surfaces of the side wall portions.

Collimators of the invention have the advantage of the ability of achieving a much finer collimation since the thinness of the blades is limited only by the size of the grooves and may be as thin as 15 microns. Also unlike the collimators of the prior art, in the collimator of the invention the blades are not mechanically assembled and thus are not subjected to warping upon assembly. Further the time and expense needed for the assembly of the large number of blades employed in a Soller slit collimator of the prior art is eliminated in the production of the collimator of the instant invention.

Preferably the grooves are formed by sawing, particularly with a precision dicing saw as is commonly employed in the semiconductor industry.

The operation of precision dicing saws is described, among other places, in Zimring U.S. Pat. No. 4,557,599, the contents of which are hereby incorporated by reference.

In general the width of the grooves is about 50 to 1000 microns and preferably from 180 to 300 microns. The thickness of the blades is from about 50 to 200 microns, preferably from about 100 to 200 microns even collimators with blades of only 25 microns thick being produced. Ceramic blocks that are particularly useful for the collimators of the invention are those containing such X-ray absorbing materials as those ceramics comprising oxides or salts of heavy metals, such as oxides of Pb, Zr and Yi or mixtures thereof being preferred.

The ceramic block may be adhesively joined together by any suitable adhesive. Preferably adhesives are those that are curable by exposure to light or by a catalyst preferably at room temperature.

Examples of adhesives that may be used are epoxy based adhesives and cyanoacrylate ester adhesives.

A preferred embodiment of the invention will now be described with reference to the figures of the drawings and the following example.

EXAMPLE

Rectangular ceramic blocks 1 and 2 each capable of abosrbing X-ray radiation and of essentially identical compositions (comprising lead titanate in an amount such that the lead content is over 60% by weight) each being 12.5 mm long, 38 mm wide, and 6.34 mm thick were placed on a saw table 3 of a precision dicing saw in a manner such that the surfaces 4 and 5 of each of said ceramic blocks are positioned along a single axis and against the fence 6 of the saw table 3. The saw table 3 with the ceramic blocks is then translated in a direction parallel to said axis toward revolving saw blade 7 the axis of which is perpendicular to the direction of travel of said saw table. The saw table 3 is positioned and moved in relation to the revolving saw blade 7 so as to cause the saw blade 7 to cut grooves 8 and 9 in ceramic blocks 1 and 2, respectively, said grooves 8 and 9 being positioned along a single axis and parallel to said surfaces 5 and 6 and each of said grooves 8 and 9 having a width of 0.247 mm, a length of 12.5 mm and a depth of 3.2 mm.

Figure 2:
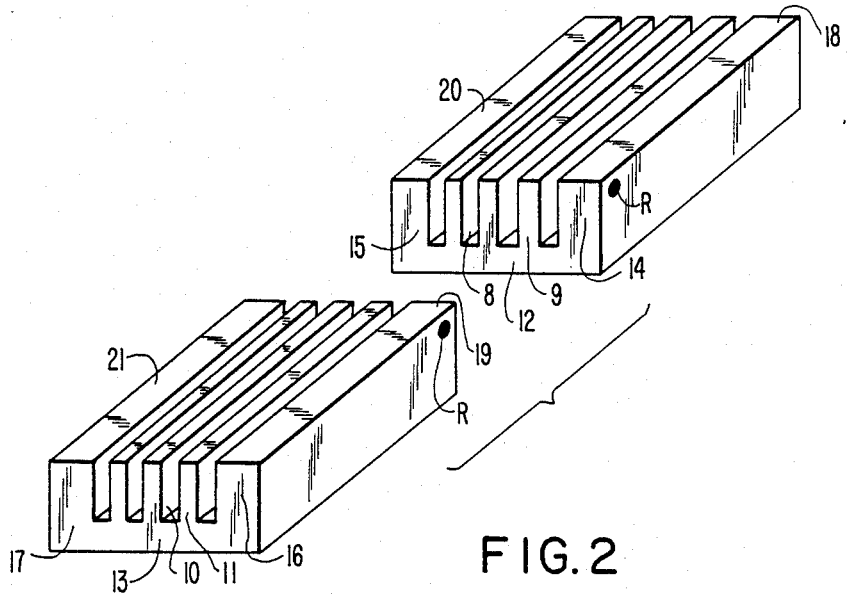
FIG. 2 is a perspective view of a matched pair of ceramic blocks provided with grooves according to the method of FIG. 1.

The saw table is then translated in a direction parallel to the axis of the saw blade and towards surfaces of said ceramic blocks parallel to said surfaces 4 and 5 by means not shown in a distance of 0.330 mm from said grooves 8 and 9 and then repeated the above-described sawing operations and translating movements of the saw table 3 so as to form a series of additional grooves 8 and 9 parallel to and identical with said first formed grooves 8 and 9 in the ceramic blocks 1 and 2, the resultant groove being separated one from the other by 0.83 thick and 12.5 mm long blades 10 and 11 projecting out of bottom wall portions 12 and 13 of ceramic blocks 1 and 2 respectively as shown in FIG. 2.

An adhesive coating, not shown, of a polycyano acrylate adhesive such as Permabond 910 is then applied to surfaces 18, 19, 20 and 21 of the side wall portions 14, 15, 16 and 17, each pair of said surfaces 18 and 20, and 19 and 21 being separated one from the other by the blades 10 and 11 and grooves 8 and 9.

Figure 3:
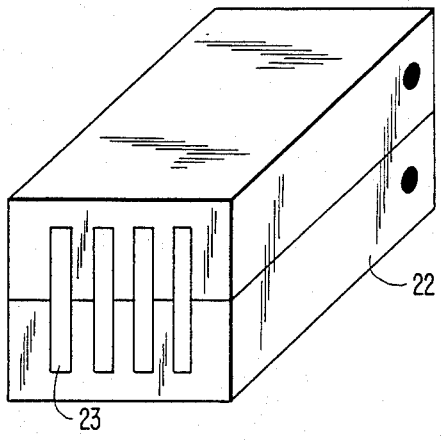
FIG. 3 is a perspective view of a Soller slit collimator of the invention formed from the grooved ceramic blocks of FIG. 2.

Ceramic block 1 is then positioned in contact with ceramic block 2 in a manner such that adhesive coated surface 19 is in contact with adhesive coated surface 18 and adhesive coateed surface 21 is in contact with adhesive coated surface 20 and blades 10 of ceramic block 1 are in contact with corresponding blades 11 of ceramic block 2 in a manner such that the axes of the blades 10 in ceramic block 1 lie parallel to with the axes of the corresponding contacting blades 11 of ceramic block 2. The adhesive layer is then allowed to harden, causing the two blocks 1 and 2 to adhere to each other and thereby forming solar slit collimator 22 provided with solar slits 23 as shown in FIG. 3.

Figure 4:
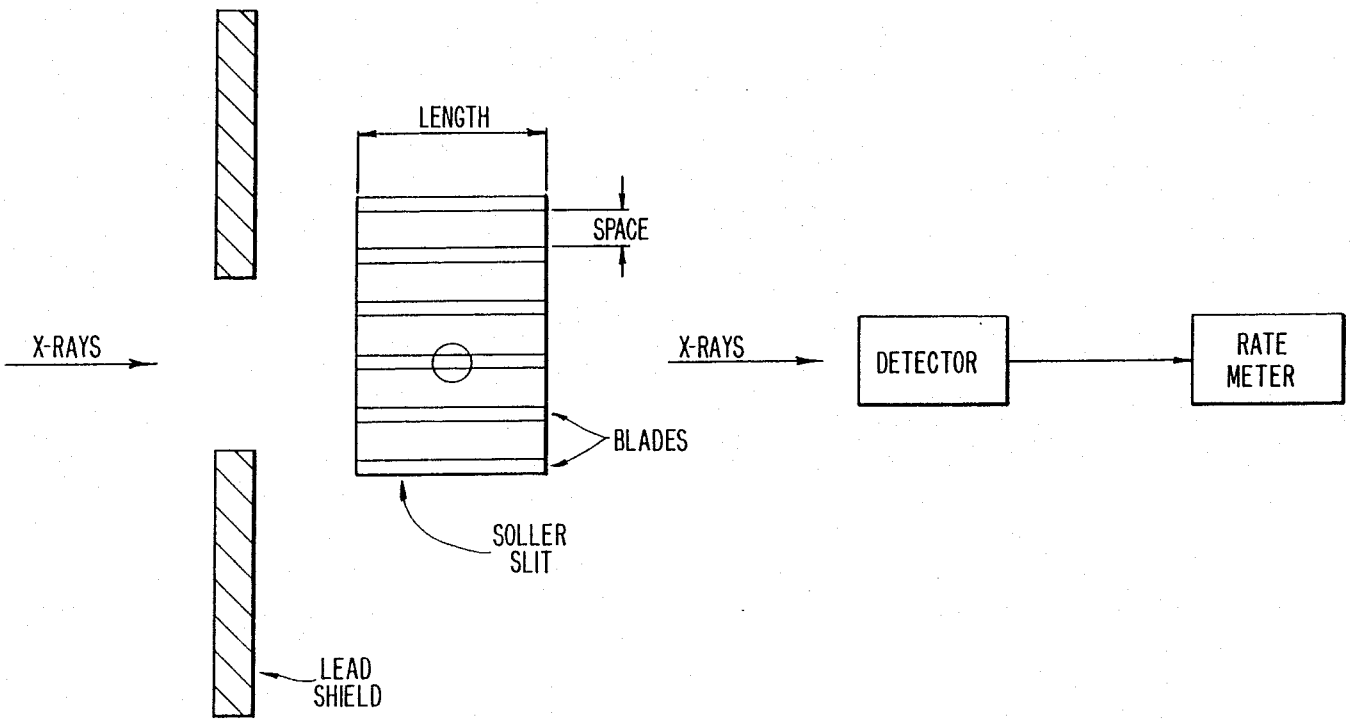
FIG. 4 is a diagrammatic view of a test set-up for determining the acceptance angle $\beta$ of a soller slit collimator of the invention.

The acceptance angle of this collimator was then determined according to the following procedure which is described below and the test assembly for which is shown diagrammatically in FIG. 4. According to this procedure, and referring to FIG. 4, an X-ray beam passing through an aperture in a lead shield of the same size as the open area of the solar slit to be tested is caused to impinge on the solar slits of a solar slit collimator mounted in the X-ray path on a rotatable table rotatable around an axis perpendicular to the axis of the X-ray path. An X-radiation detector and a ratemeter is provided on the side of the solar slit collimator remote from the X-ray source. The rotary table with the solar slit collimator thereon is rotated until there is no count rate on the ratemeter. The rotary table is then rotated in the opposite direction and the count rate reading is taken every 10 minutes of the arc.

The data obtained by employing the solar slit collimator of the example is tabulated in the following Table

TABLE 1

Test Data for Soller Slit PL #2

| Position of Rotary Table (Degrees) | | Ratemeter (counts per sec.) |
|---|---|---|
| 0° | | 0 |
| 0° 30′ | | 0 |
| 0° 40′ | | 80 |
| 0° 50′ | | 140 |
| 1° 0′ | | 250 |
| 1° 10′ | | 400 |
| 1° 20′ | | 600 |
| 1° 30′ | | 720 |
| 1° 40′ | 2° 10′ | 700 |
| 1° 50′ | | 500 |
| 2° 0′ | | 380 |
| 2° 10′ | | 220 |
| 2° 20′ | | 120 |
| 2° 30′ | | 140 |
| 2° 40′ | | 70 |
| 2° 50′ | | 0 |
| 3° 0′ | | 0 |

It will be noted that the table of the acceptance angle for this solar slit collimator was measured with determined to be 2° 10′ or 2.16° a satisfactory agreement with the theoretical or calculated acceptance angle $\beta$ where $\beta$ equals $2\theta$ and tan $\theta$ equals the width of the opening between the blades divided by the length of the blades, in this case being 247 divided by 12.5 $\theta$ equaling 1.1° $\theta$ therefore equaling 2.2°.

What is claimed:

1. A method of producing a Soller slit collimator for use in X-ray analysis, said method comprising (a) forming a plurality of narrow grooves perpendicular to two parallel surfaces of two rectangular ceramic blocks of essentially identical configuration and composition and capable of absorbing X-radiation each of said grooves being separated from each other by a blade, each of said ceramic blocks being provided with upper and lower wall portions parallel to said grooves, (b) positioning said resultant grooved ceramic blocks in a facing relationship with each other so that corresponding surfaces of the upper and lower wall portions and corresponding blades of said ceramic blocks are in mutual contact and in an essentially parallel relationship with each other and (c) adhesively binding together said ceramic block along the corresponding surfaces of top and bottom wall portions of said ceramic blocks.

2. A method of producing a Soller slit for use in X-ray analysis, said method comprising:

(a) positioning two rectangular ceramic blocks of essentially identical composition and configuration, and capable of absorbing X-radiation, in a single plane in a manner such that a surface of one of said blocks is parallel with and opposing to a surface of the other block and an axis of one block is convergent with an axis of the other block.

(b) simultaneously forming a plurality of grooves perpendicular to said two surfaces of said ceramic blocks, each of said grooves being separated from each other by a blade projecting from a surface of said ceramic block, each of said grooves having a width of about 50 to 1000 microns, each of said blades having a thickness of 50 to 200 microns and each of said ceramic blocks being provided with upper and lower wall portions parallel to said grooves;

(c) positioning the resultant grooved ceramic blocks in a facing relationship with each other so that corresponding surfaces of the upper and lower wall portions and corresponding blades of said ceramic blocks are in mutual contact and in an essentially parallel relationship with each other and (d) adhesively binding together said ceramic blocks along the corresponding surfaces of top and bottom wall portions of said ceramic blocks.

3. A Soller slit collimator for use in X-ray analysis, said collimator comprising two rectangular ceramic blocks, each of said blocks being of essentially identical composition and configuration, each of said blocks containing heavy elements and being capable of absorbing X-radiation, each of said blocks having a plurality of parallel blades projecting out of a solid wall portion of said block and in contact and parallel facing relationship with a corresponding blade of said other block and said blocks being adhesively bound to said other at corresponding surfaces of upper and lower wall portions of said blocks.

4. The method of claim 2 wherein the ceramic block comprising an oxide of at least one element selected from the group consisting of lead, zirconium and titanium.

5. The collimator of claim 3 wherein the ceramic block comprising an oxide of at least one element selected from the group consisting of lead, zirconium and titanium.

6. The method of claim 4 wherein the grooves are about 150 microns wide and the blades are about 25 microns thick.

7. The collimator of claim 5 wherein the grooves are about 150 microns wide and the blades are about 25 microns thick.

8. The method of claim 4 wherein each of the ceramic blocks comprise a lead titanate.

9. The collimator of claim 5 wherein each of the ceramic blocks comprise a lead titanate.

10. The method of claim 2 wherein the grooves are formed by sawing.

11. The method of claim 2 wherein the ceramic blocks are adhesively bound together with an epoxy adhesive.

12. The collimator of claim 3 wherein the ceramic blocks are adhesively bound to each other with an epoxy adhesive.

* * * * *